US006712062B2

(12) United States Patent
Wildenburg

(10) Patent No.: US 6,712,062 B2
(45) Date of Patent: Mar. 30, 2004

(54) SINTERED METAL BONDED SEGMENTS WITH AN ABRASIVE ACTION, FOR TOOLS

(75) Inventor: Jörg Wildenburg, Himmelkron (DE)

(73) Assignee: Siegfried Golz GmbH & Co., Hellenthal-Blumenthal (DE)

( * ) Notice: Subject to any disclaimer, the term of this patent is extended or adjusted under 35 U.S.C. 154(b) by 0 days.

(21) Appl. No.: 10/182,316

(22) PCT Filed: Feb. 5, 2001

(86) PCT No.: PCT/EP01/01194

§ 371 (c)(1),
(2), (4) Date: Oct. 25, 2002

(87) PCT Pub. No.: WO01/56745

PCT Pub. Date: Aug. 9, 2001

(65) Prior Publication Data

US 2003/0148723 A1 Aug. 7, 2003

(30) Foreign Application Priority Data

Feb. 4, 2000 (DE) ..... 100 05 064

(51) Int. Cl.[7] ..... B28D 1/04

(52) U.S. Cl. ..... 125/15; 125/12; 125/22; 451/527; 451/529; 451/540; 451/548

(58) Field of Search ..... 125/12, 15, 22; 451/527, 529, 540, 548

(56) References Cited

U.S. PATENT DOCUMENTS

| | | | | |
|---|---|---|---|---|
| 5,868,885 A | | 2/1999 | Crockett et al. | |
| 6,110,031 A | * | 8/2000 | Preston et al. | 451/541 |
| 6,196,911 B1 | * | 3/2001 | Preston et al. | 451/548 |

FOREIGN PATENT DOCUMENTS

| | | |
|---|---|---|
| DE | 44 24 093 A1 | 1/1995 |
| DE | 195 49 381 A1 | 12/1996 |
| DE | 196 50 480 A1 | 6/1998 |
| EP | 0 540 566 B1 | 7/1991 |
| EP | 0 857 552 A2 | 1/1998 |

* cited by examiner

*Primary Examiner*—Lee D. Wilson
*Assistant Examiner*—Shantese McDonald
(74) *Attorney, Agent, or Firm*—Pauley Petersen & Erickson

(57) ABSTRACT

Sintered metal bonded segments with an abrasive action, and containing particles of hard material, for tools for machining or cutting hard and/or brittle materials with a tool support which accommodates the sintered metal bonded segments, which are made up of individual segment modules.

32 Claims, 4 Drawing Sheets

Fig. 4a
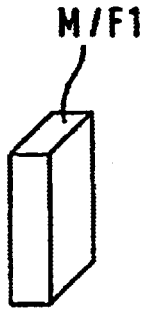
Fig. 4b
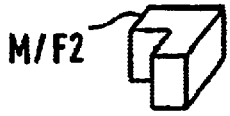
Fig. 4c
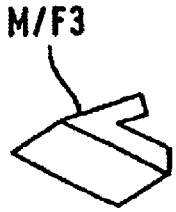
Fig. 4f
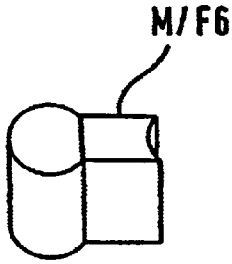
Fig. 4d
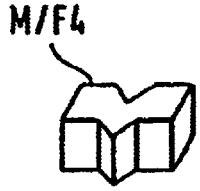
Fig. 4g
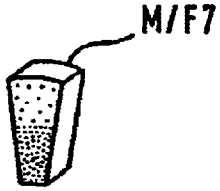
Fig. 4e
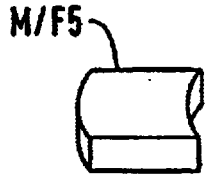
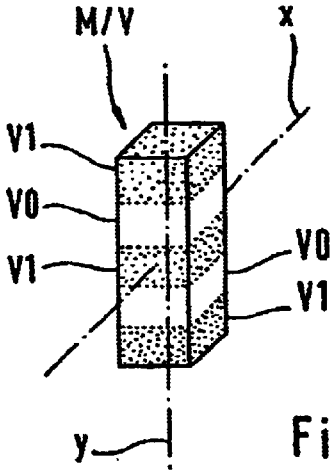
Fig. 17
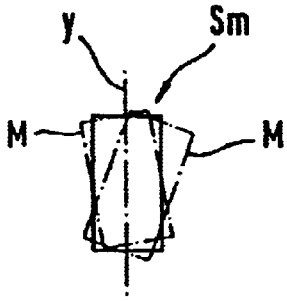
Fig. 15
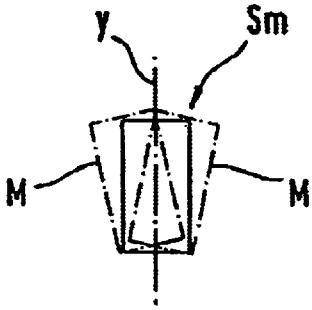
Fig. 16

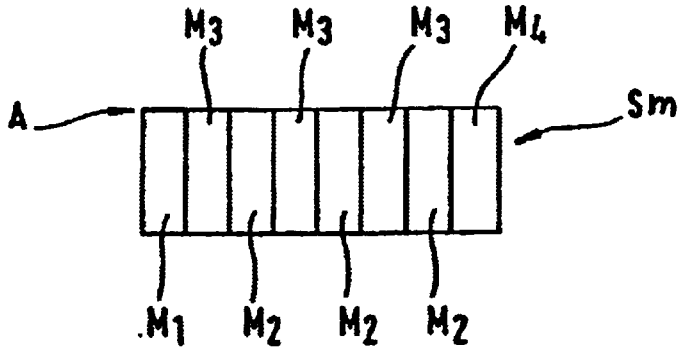
Fig. 5
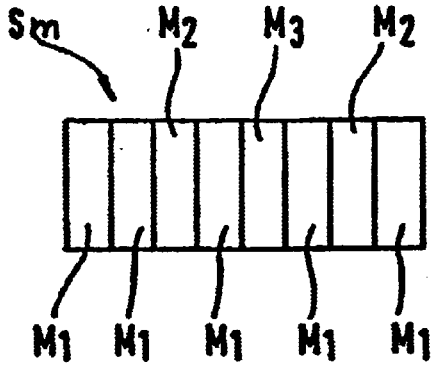
Fig. 6
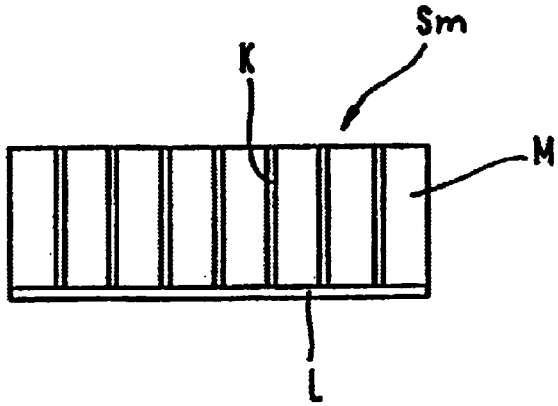
Fig. 7
Fig. 8
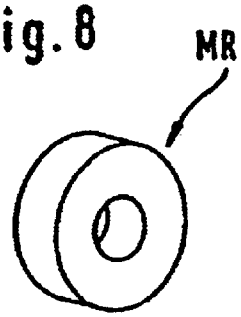
Fig. 9
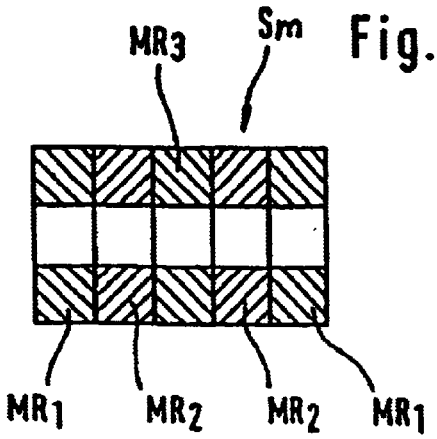

SINTERED METAL BONDED SEGMENTS WITH AN ABRASIVE ACTION, FOR TOOLS

BACKGROUND OF THE INVENTION

1. Field of the Invention

This invention relates to sintered metal bonded segments with an abrasive action, containing particles of hard material, for tools for machining or cutting hard and/or brittle materials with a tool support which accommodates the segments, wherein each segment is made up of individual segment modules that are variously formed.

2. Discussion of Related Art

Abrasively configured segments for tools, for example in the form of cutting segments for drill bits, milling cutters, chainsaws, saw blades, parting grinder wheels, hollow trepanning bits, grinding blades or in the form of hollow rollers for band saws are essential for machining or cutting materials.

The prior art is represented by German Patent Reference DE 196 50 480 A1, European Patent Reference EP 0 857 552 A2, German Patent Reference DE 44 24 093 A1, U.S. Pat. No. 5,868,885 and U.S. Pat. No. 5,518,443, to name a very few examples. The tools and segments for the tools are produced using diamonds as the hard material and are correspondingly expensive to manufacture.

Among the toolmaking equipment for manufacturing diamond tools in all shapes and for all applications, the manufacturers of such tools keep an enormous variety of designs and production tools for those designs, for example the various segments and segment sizes for the widest imaginable range of tools. The result of this is exceedingly high production and storage effort, for example in the case of diamond saw blades, so that cutting segments in all desired radii are available. The essential production tools are expensive and because of their sophisticated construction are also delicate.

Manufacturers of diamond tools often find that they cannot ship or perhaps even manufacture the tool desired for a special customer requirement, quickly enough. This applies for diamond tools in all industry sectors, from the professional "high-end" tool down to the supermarket product. At the same time, the tool must comply with the highest possible standards of safety and performance.

A cutting tool is known from European Patent Reference EP 0 540 566 B1 in which the configuration of the individual cutting segments changes at a constant rate over the length of the segment, such as the quality and/or the concentration of the abrasive grain is varied at a constant rate. This may be achieved by constructing the cutting segment from a single piece, or also by combining multiple parts to form the cutting segment. In the latter case, when viewed from one direction, for example the abrasive grain then becomes less concentrated at a constant rate.

The cutting segment described in U.S. Pat. No. 5,518,443 is also made from a single piece and requires a great deal of manufacturing effort due to the varying concentrations of hard materials in the different areas.

SUMMARY OF THE INVENTION

One object of this invention is to provide a multiplicity of tool segment shapes containing hard material particles, particularly very hard materials such as diamonds or cubic boron nitride, to be accomplished in a reasonable manner, and in same manner to arrange the manufacture and storage thereof more economically and to reduce costs. A further object is to improve the performance of the tools, such as to enable optimum use of the hard material particles, and to make segments that are more resistant to wear, and which therefore last longer.

These and other objects are solved by this invention because sintered metal bonded segments with abrasive action are constructed from individual segment modules having identical construction and the segment modules are manufactured by high-temperature isostatic pressing and the segments are constructed from segment modules presenting alternating concentrations of hard material particles starting from the leading area and progressing towards the trailing area of the segment in the direction of motion of the segment, and/or from segment modules including varying areas having alternating concentrations of hard materials that are arranged perpendicularly to the direction of motion of the segment. According to one embodiment of this invention, the segment modules may have the same or differing shapes and may be constituted from the same sintered metal materials and/or hard material particles, or from sintered metal materials and/or hard material particles that differ both qualitatively and quantitatively. Advantageous configurations of this invention are described by features of the claims.

One concept fundamental to the principle of this invention is simplification of the geometry so that a modular construction enables drastically reduced storage requirements, improved tool quality and durability, and virtually limitless design variations for the product.

This invention is the first to describe sintered metal bonded segments with abrasive action that are constructed in modules and graduations for machining or cutting materials. Thus, a sawtooth effect is also achieved according to this invention by the alternating concentrations of hard material particles.

According to this invention, a small number of basic types of segment module is sufficient to obtain a multiplicity of different segments in terms of shape and quality by mixing, combining and arranging similar and/or differing segment modules.

BRIEF DESCRIPTION OF THE DRAWINGS

This invention is described in detail with reference to exemplary embodiments shown in the drawings, wherein:

FIGS. 4*a–g* each is a perspective view of one of various shapes of segment modules;

FIGS. 5 and 6 each is a front view of one of various arrangements of segment modules to form a segment;

FIG. 7 is a front view of a modularly constructed cutting segment in a sprung configuration;

FIG. 8 is a perspective view of a segment module conformed annularly;

FIG. 9 is a view of a cross section taken through a segment in a form of a hollow roller constructed modularly from annularly shaped segment modules;

FIGS. 15 and 16 each shows one of various arrangements of segment modules in a segment; and FIG. 17 is a perspective view of a vertically graduated segment module.

DESCRIPTION OF PREFERRED EMBODIMENTS

Figure 1:
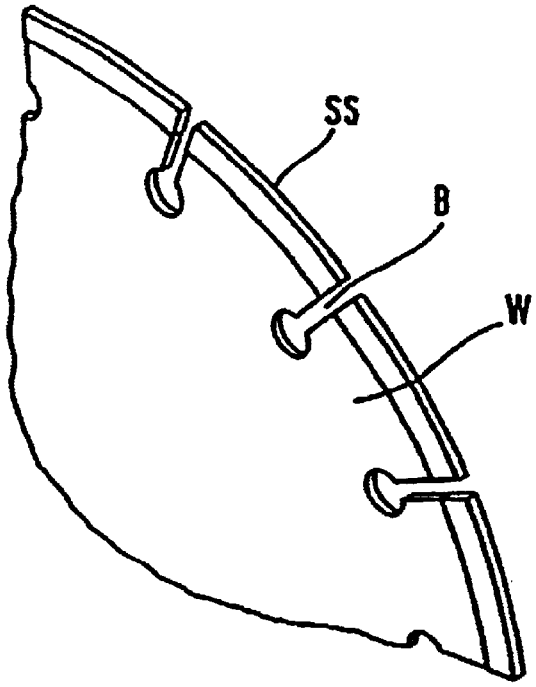
FIG. 1 is a perspective view of a section of a circular saw blade with inserted cutting segments according to prior art.

FIG. 1 shows an example of a diamond tool in the form of a circular saw blade, having a tool support W made from metal, and which is conformed at intervals on the circumference with cooling slots B and which is furnished between every two cooling slots an inserted segment SS configured as a cutting segment. These segments SS for circular saws are normally made from sintered metal with embedded hard materials, preferably diamond grit, each as a single piece, such as one unit. These segments SS are manufactured in a molding operation, in which a blank is clamped into graphite molds and sintered using pressure and heat to create the segment. Depending on the various sizes and qualities required, higher or lower diamond grit content, a correspondingly greater number of press molds are needed, and the storage requirements for the different individual segments for the various sizes and qualities of saw blades are also increased.

Manufacturing segments with sophisticated mixing processes and multistage molding and sintering operations demands a considerable investment in terms of cost and equipment. Manufacturers of such segments, for instance cutting segments for circular saw blades or trepanning bits must maintain a permanent stock of several hundred types of such segments. Otherwise they cannot timely respond to customer orders. The types are categorized according to their adaptation for use with the various materials to be worked, and according to the different size classes of the tools. Critical characteristics are the type and composition of the metal sintered matrix, which may vary, the content and distribution of the hard materials, such as diamond grit, and the geometrical dimensions of the segments. These factors are compounded in practical application.

An example of a typical segment for a saw blade may have dimensions 40×3.6×7 mm and a radius of 225 mm and may be attached by soldering, laser welding, or direct sintering to a circular saw blade having a diameter of 450 mm, tool support W, for cutting concrete, natural stone, artificial stone, ceramics and asphalt. But for this one size of circular saw blade, there are at least four different composition types, such as segment configurations in at least two different qualities. At least 33 different radius sizes are in common use for circular saw blades and tool supports. In addition, one must deal with at least four segment variants, including footless, with foot, sandwich type, inclined or protective segment, conical segments, capping segments, flexible and slotted segments. The various combinations of all these features give a total of 1,848 different segments, which may be reduced by a number of uncommon combinations. It is thus clear that the manufacturer must contend with considerable costs due to the wide variety and associated stocking requirements.

Figure 2:
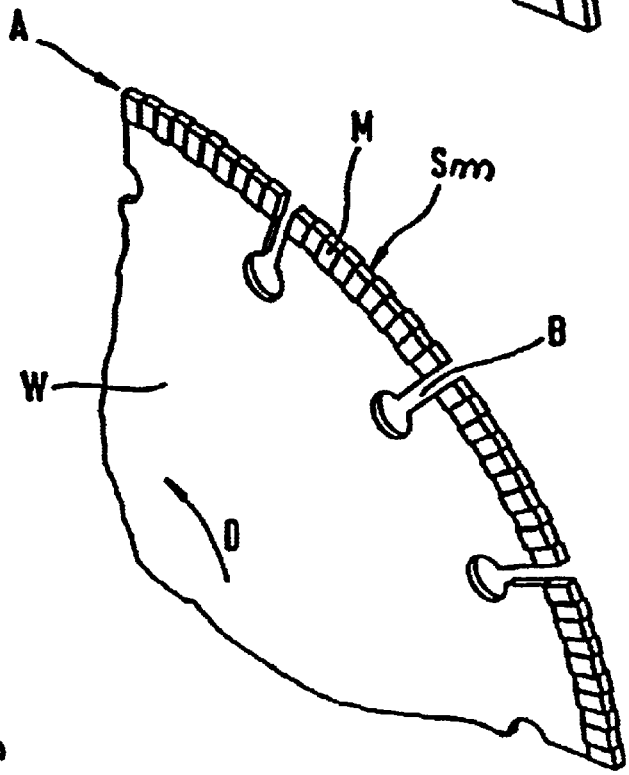
FIG. 2 is a perspective view of a section of a saw blade with modularly constructed cutting segments.
Figure 3:
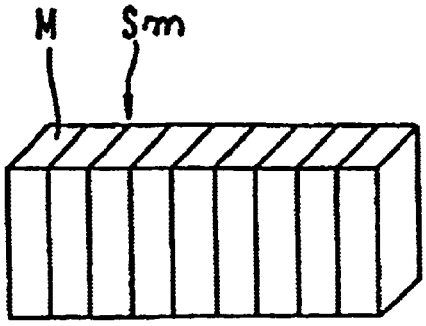
FIG. 3 is a perspective view of a modularly constructed segment.

This is where this invention assumes its significance. FIG. 2 shows a cross section of the saw blade that is furnished with modularly constructed segments Sm of this invention, wherein each segment Sm is formed of a plurality of segment modules M. According to the invention, a typical, commonly available cutting segment of such kind for a circular saw is divided into any number of small segment modules M, for example of the same construction and size and offering the capability of various compositions, for example differing hard material contents, as shown in FIG. 3, and thereby providing an additional range of variation options besides that offered by the simple constitution and construction of segments of differing sizes and varying qualities, thereby leading to a sharp reduction in the number of individual segment types that must be held in inventory. With a small number of basic types of segment modules, a wide variety of segments may be created by mixing, combining and arranging the modules differently. It is even possible to achieve new qualities that until now have been impossible to achieve.

Many variables are conceivable and include:

- various segment module shapes, indicated by F1, F2, F3, etc.;
- segment modules metallic bonds, such as with sintered metals that differ with regard to quality and/or quantity, indicated by B1, B2, B3, etc.;
- segment modules with differing concentrations of hard materials from 0 to 100% by weight, indicated by K1, K2, K3, etc.;
- segment modules with hard materials that differ in terms of quality indicated by, Q1, Q2, Q3, etc.;
- segment modules of similar construction but different sizes, to enable grouping by height and thus achieve a sawtooth effect indicated by F';
- segment modules with vertical graduation relative to the axis of motion of segment V;
- various pattern groupings of similar and different segment modules in one modular segment; and
- segment modules having the same shape and the same composition.

Each segment module may be characterized as follows according to the previously listed properties: M (F, K, B, Q, V).

From these, the segment modules may be varied in the following exemplary manner by varying the individual parameters: M1 (F1, K1, B1, Q1); M2 (F1, K2, B1, Q1); M3 (F1, K3, B1, Q1); M4 (F1, K1, B1, Q2); etc.

Possible shapes F for the segment modules may include for example cuboids F1 as shown in FIG. 4*a*, elbows F2 as shown in FIG. 4*b*, V-shapes F3 as shown in FIG. 4*c*, C-shapes F4 as shown in FIG. 4*d*, key shapes F5 as shown in FIG. 4*e*, or link shapes F6 as shown in FIG. 4*f*, or truncated pie-shapes as shown in FIG. 4*g*, or ring-shapes R as shown in FIG. 8.

Segment modules may be produced having the same shape, for example cuboids, as shown in FIG. 4, but, for example, containing different quantities of expensive hard materials, such as diamonds, to create segments as shown in FIG. 5 therefrom, for example as cutting segments for a saw blade, and where the working edge A is made from a segment module Ml, as shown in FIG. 5, that contains a very high quantity of hard material, such as diamonds, unlike the following segment modules, which are enriched alternatingly with low and somewhat higher hard material particles. The content of hard material particles in the segment modules falls as the designator rises. Thus, it is possible to produce an inexpensive segment from segment modules while making optimum use of hard materials. The pattern groupings of a segment including different segment modules vary according to the tool and the materials to be worked, the segments may be symmetrically or asymmetrically configured from various segment modules, see for example the segment pattern in FIG. 6.

According to this invention, it is possible to miniaturize the segment modules and to produce segment modules having extremely small thickness, down to the thickness of foil.

One important principle of this invention is that the segments are constituted from segment modules, so that it is possible to graduate the individual segment modules, such as to equip them with varying quantities and/or qualities of hard materials, and to produce varying qualities of modularly constructed segments therefrom to match a range of specifications.

Materials for the metal bond of the segment modules may include sintered metals such as alloys having cobalt, copper, tungsten, nickel, iron, titanium, tin, aluminium and/or silicon base.

The segment modules according to this invention made from sintered metals and hard materials may be manufactured by high-temperature isostatic pressing (HIP) which enables many segment modules to be made at the same time. The segment modules may then be arranged together by robots to form any kind of modular segment, so that the respectively desired qualities and shapes of segments may be made very quickly from the relatively small number of different segment modules.

As shown in FIG. 7, the segments Sm constructed modularly from segment modules M may be furnished at this point with a solder base L on the face that is to be joined subsequently to the tool support. It is possible to introduce, for example, an adhesive substance or plastic K in the voids between adjacent segment modules M, thus lending a certain elastic property to segment Sm.

A further example of the shape segment modules may take is the ring, as shown in FIG. 8 with annular segment module MR. Such annular segment modules may be used to form hollow rollers modularly, for example, as shown in FIG. 9. Hollow rollers are essential for the operation of band saws. Here too, the individual segment modules may be formed variously, for instance with respect to their hard material content, for example they may be graduated, enabling inexpensive manufacture of a modular segment in the form of a hollow roller.

Figure 10:
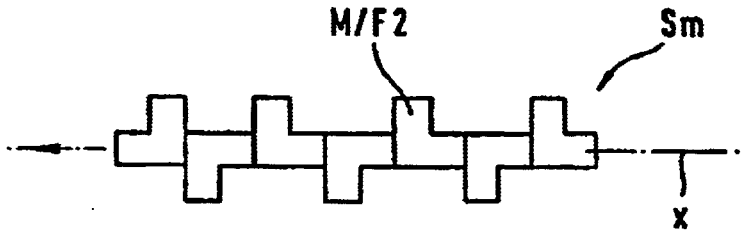
FIGS. 10 to 13 and 14*a* and *b* each shows a view of a formation of one of segments from variously shaped segment modules.
Figure 11:
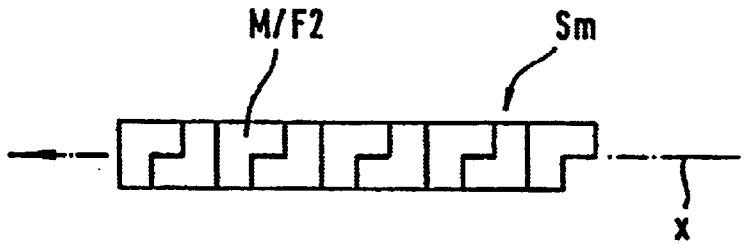

The modular method for constructing cutting segments for tools from individual variously configured segment modules as proposed by this invention enables the creation of a large variety of segments having varying properties from a small number of basic segment module types by mixture, combination and arrangement thereof. It is even possible to create new tools that could not previously be made. The modular construction further eliminates constraints on a different level, by also allowing lateral offset of segment modules within a segment, lateral offset of the segment modules with respect to the longitudinal axis or axis of motion of the segment, and in alternating manner to one or the other side in both cases. FIG. 11 is a schematic top view of the configuration of a cutting segment made from elbow-shaped segment modules M/F2, which are arranged in an interlocking fit to form a closed segment. However, as is shown in FIG. 10, it is also possible to arrange the elbow-shaped segment modules in such manner that parts thereof, in this case a perpendicular leg projects laterally, i.e. from each side in alternating manner, wherein the center line or the axis of motion of segment Sm is indicated by x. This formation of a segment SS is only possible using the module construction method and the correspondingly conformed segment modules according to this invention, and the laterally projecting parts of the segment modules fulfil the function of cooling ribs, thereby extending the operating life of the cutting segment and improving the quality of the cutting effect.

Figure 12:
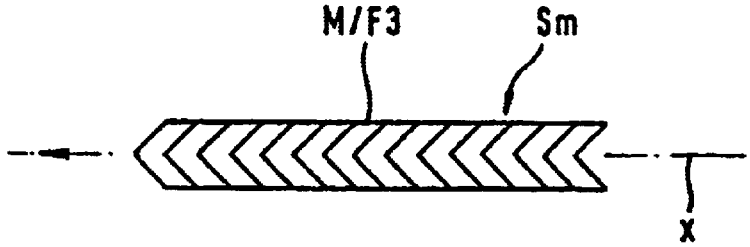
Figure 13:
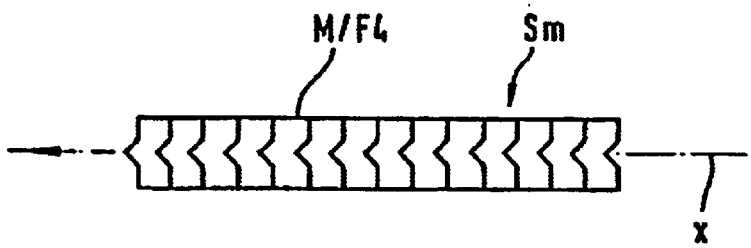

FIG. 12 is an exemplary illustration of an interlocking arrangement of V-shaped elements as segment modules M/F3, which for example may be configured to provide a sharp edge X in the leading area in the direction of motion. FIG. 13 is an exemplary illustration of the construction of a cutting segment from segment modules shaped as exemplified by M/F4.

Figure 14A:
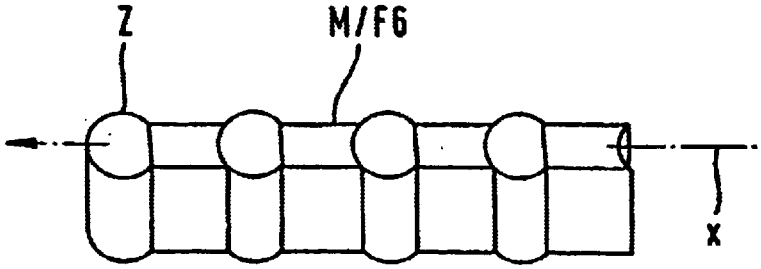
Figure 14B:
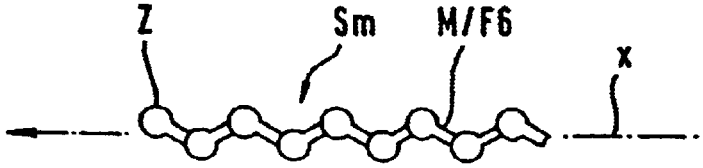

FIG. 14*a* shows segment modules in the shape of chain links M/F6 that are combined along their center line X to form a cutting segment Sm, wherein the bulging areas z also protrude laterally outside the limits of the segment Sm formed thereby, and thus again have a cooling effect. FIG. 14*b* illustrates a method whereby this cooling effect may be enhanced by a correspondingly offset arrangement of segment modules M/F6.

To ensure that the cutting force remains uniform within a segment module, the area having a smaller cross section may include a higher percentage of hard material than the areas having a larger cross section. This also ensures that wear is distributed evenly. Such a configuration may be achieved using a segment module M/F7 as shown in FIG. 4*g*.

A further configuration of cutting segments in the modularized construction using segment modules that have a cooling effect may be achieved by tilting individual segment modules M alternately to either side out of alignment with respect to center line Y, within their arrangement in the segment, for example either as shown by the arrangement in FIG. 15 or by that in FIG. 16, which also have the effect of cooling ribs. Moreover, this arrangement serves as a self-sharpening device for segment Sm.

A further capability according to this invention to graduate the segment using segment modules may be accomplished if the individual segment modules themselves are graduated, such as if they include areas containing differing concentrations of hard materials, that are perpendicular y to direction of motion x, as is shown in exemplary manner in FIG. 17. Cuboid segment module MN has a vertical graduation including five areas, of which three areas V1 are designed with a specified concentration of hard materials, and intermediate areas VO include a lower concentration of hard materials, perhaps none at all. Cutting segments that are formed from vertically graduated segment modules are able to be adapted radially to the typical cutting behavior of cutting tools. A saw blade, as shown in FIG. 2, which is constructed with segments Sm constituted from segment modules M/V as shown in FIG. 17, saws rapidly and always with uniform power from beginning to end.

Other possibilities for adapting modularly constructed cutting segments for enhanced resistance to wear and improved cutting properties are provided because the sintered metal matrix of the individual segment modules of a cutting segment may be variously configured. Even the grain size of the hard material particles as well as the quality of the hard material particles, meaning that hard material particles other than diamonds may be used and modified, contributes to the ability to adapt cutting segments in a specific manner for a specific purpose.

The alternating concentration of hard material particles in segment modules within a segment, for example in sequences M1, M2, M1, M2, M1, M2 . . . or M1, M2, M3, M1, M2, M3, M1, M2, M3 . . . provides a sawtooth effect. The segments that are made from segment modules containing varying concentrations of a hard material have a leading segment module M1 in the direction of motion of the segment that contains the highest concentration of hard materials. The segment module is followed by a segment module M2 having a minimum concentration of hard materials and then by a further segment module M3 or M1 containing a concentration higher than the minimum concentration up to the maximum concentration of hard materials, and further segment modules in similar alternating sequence.

Non-metallic hard materials may particularly be chosen from synthetic or natural diamonds, boron carbide, silicon carbide, aluminium oxide and/or cubic boron nitride.

In the construction of segments from segment modules, the void remaining between the adjacent segments in a segment may be filled with an adhesive or plastic substance. Particularly if elastomeric plastics are used, it is possible to endow the segments with elastic properties.

The segments may be bonded to the tool support in known manner using wettable solders, which also penetrate and thus serve to seal the voids between the segment modules.

However, it is also possible to weld the segment to the metal tool support, and to weld the segment modules together, using resistance heating or a laser, which particularly in the area of adjacent modules produces an effect akin to spot welding.

Lateral tilting by a few minutes or degrees of the segment modules, as shown in exemplary manner in FIGS. 15 and 16, also serves as a self-sharpening device for the cutting segment.

What is claimed is:

1. In sintered metal bonded segments with an abrasive action, containing particles of a hard material, for tools for machining or cutting hard and/or brittle materials with a tool support which accommodates the segments, wherein each of the segments is made of individual segment modules that are variously formed, the improvement comprising: the segments constructed from at least one of the segment modules having identical construction and the segment modules manufactured by high-temperature isostatic pressing and the segments constructed from the segment modules containing alternating concentrations of the hard material particles starting at a leading area of a working edge and progressing towards a trailing area of each of the segments in a direction of motion of the segment, and from the segment modules including varying areas having alternating concentrations of the hard materials arranged perpendicularly to the direction of motion of the segment.

2. In the segments according to claim 1, wherein the segments are constituted from segment modules having the same composition of sintered metals.

3. In the segments according to claim 2, wherein the segments are constituted from the segment modules having a same composition of hard material particles.

4. In the segments according to claim 1, wherein the segments are constituted from the segment modules having differing compositions of at least one of the sintered metals and the hard material particles.

5. In the segments according to claim 4, wherein the segments are constituted from the segment modules containing at least one of various sintered metals and differing quantitative compositions of the sintered metals as metallic bonds.

6. In the segments according to claim 4, wherein the segments are made from the segment modules containing varying concentrations of the hard material, wherein a leading segment module in the direction of motion contains a highest concentration of the hard materials is followed by one of the segment modules having a minimum concentration of the hard materials and then further by one of the segment modules containing a concentration higher than a minimum concentration up to a maximum concentration of the hard materials, and further ones of the segment modules follow in similar alternating sequence to form a segment with sawtooth effect.

7. In the segments according to claim 6, wherein the different segment modules of a segment contain from 0 to 100% by weight of the hard material particles.

8. In the segments according to claim 4, wherein the segments are constituted from the segment modules containing one of various sintered metals and quantitatively differing compositions of the sintered metals as metal bonds, and that contain varying concentrations of a hard material.

9. In the segments according to claim 8, wherein the segments are constituted from the segment modules having a same shape and differing compositions of at least one of the sintered metals and the hard materials in terms of at least one of quality and quantity.

10. In the segments according to claim 9, wherein the segment modules are cuboid in shape.

11. In the segments according to claim 10, wherein the segments are constituted from cuboid segment modules of differing heights, thereby creating a sawtooth effect.

12. In the segments according to claim 9, wherein the segments in a shape of hollow rollers are formed from the annularly shaped segment modules.

13. In the segments according to claim 9, wherein the segment modules are conformed in one of elbow shapes (F2), V shapes (F3), key shapes (F4) and chain link shapes (F6).

14. In the segments according to claim 13, wherein the segment modules of the segment are one of offset and tilted alternately to a side out of alignment with a center line relative to the direction of motion to create cooling ribs.

15. In the segments according to claim 13, wherein the segment modules are arranged in alternating manner symmetrically about a single axis of symmetry in the segment so that from a perspective of the direction of motion and the center line of the segment, a part of the segment module protrudes to form a cooling rib on the side in alternating manner.

16. In the segments according to claim 15, wherein voids remaining between the adjacent segments combined to form the segment are filled with one of an adhesive and a plastic substance.

17. In the segments according to claim 15, wherein the segments are welded to the tool support, and the segment modules are welded together using one of a resistance heating and a laser.

18. In the segments according to claim 1, wherein the segments are constituted from the segment modules having a same composition of hard material particles.

19. In the segments according to claim 1, wherein the segments are constituted from the segment modules having differing compositions of at least one of the sintered metals and the hard material particles.

20. In the segments according to claim 19, wherein the segments are constituted from the segment modules containing at least one of various sintered metals and differing quantitative compositions of the sintered metals as metallic bonds.

21. In the segments according to claim 19, wherein the segments are made from the segment modules containing varying concentrations of the hard material, wherein a leading segment module in the direction of motion contains a highest concentration of the hard materials is followed by one of the segment modules having a minimum concentration of the hard materials and then further by one of the segment modules containing a concentration higher than a minimum concentration up to a maximum concentration of the hard materials, and further ones of the segment modules follow in similar alternating sequence to form a segment with sawtooth effect.

22. In the segments according to claim 19, wherein the segments are constituted from the segment modules containing one of various sintered metals and quantitatively differing compositions of the sintered metals as metal bonds, and that contain varying concentrations of a hard material.

23. In the segments according to claim 19, wherein the segments are constituted from the segment modules having a same shape and differing compositions of at least one of the sintered metals and the hard materials in terms of at least one of quality and quantity.

24. In the segments according to claim 1, wherein the different segment modules of a segment contain from 0 to 100% by weight of the hard material particles.

25. In the segments according to claim 1, wherein the segment modules are cuboid in shape.

26. In the segments according to claim 25, wherein the segments are constituted from cuboid segment modules of differing heights, thereby creating a sawtooth effect.

27. In the segments according to claim 1, wherein the segments in a shape of hollow rollers are formed from the annularly shaped segment modules.

28. In the segments according to claim 1, wherein the segment modules are conformed in one of elbow shapes (F2), V shapes (F3), key shapes (F4) and chain link shapes (F6).

29. In the segments according to claim 1, wherein the segment modules of the segment are one of offset and tilted alternately to a side out of alignment with a center line relative to the direction of motion to create cooling ribs.

30. In the segments according to claim 1, wherein the segment modules are arranged in alternating manner symmetrically about a single axis of symmetry in the segment so that from a perspective of the direction of motion and a center line of the segment, a part of the segment module protrudes to form a cooling rib on the side in alternating manner.

31. In the segments according to claim 1, wherein voids remaining between the adjacent segments combined to form the segment are filled with one of an adhesive and a plastic substance.

32. In the segments according to claim 1, wherein the segments are welded to the tool support, and the segment modules are welded together using one of a resistance heating and a laser.

* * * * *